US011289036B2

(12) United States Patent
Sim et al.

(10) Patent No.: US 11,289,036 B2
(45) Date of Patent: Mar. 29, 2022

(54) METHODS FOR DRIVING ELECTRO-OPTIC DISPLAYS

(71) Applicant: E INK CORPORATION, Billerica, MA (US)

(72) Inventors: Teck Ping Sim, Acton, MA (US); Yuval Ben-Dov, Cambridge, MA (US)

(73) Assignee: E Ink Corporation, Billerica, MA (US)

( * ) Notice: Subject to any disclaimer, the term of this patent is extended or adjusted under 35 U.S.C. 154(b) by 0 days.

(21) Appl. No.: 17/097,130

(22) Filed: Nov. 13, 2020

(65) Prior Publication Data

US 2021/0150992 A1 May 20, 2021

Related U.S. Application Data

(60) Provisional application No. 62/935,175, filed on Nov. 14, 2019.

(51) Int. Cl.
*G09G 3/34* (2006.01)

(52) U.S. Cl.
CPC ..... *G09G 3/344* (2013.01); *G09G 2310/04* (2013.01); *G09G 2340/14* (2013.01)

(58) Field of Classification Search
CPC ..... G09G 3/344
See application file for complete search history.

(56) References Cited

U.S. PATENT DOCUMENTS 4,418,346 A 11/1983 Batchelder
5,760,761 A 6/1998 Sheridon
5,777,782 A 7/1998 Sheridon
5,808,783 A 9/1998 Crowley
5,872,552 A 2/1999 Gordon, II et al.
5,930,026 A 7/1999 Jacobson et al.
6,054,071 A 4/2000 Mikkelsen, Jr.
6,055,091 A 4/2000 Sheridon et al.
6,097,531 A 8/2000 Sheridon
6,128,124 A 10/2000 Silverman
6,130,774 A 10/2000 Albert et al.
6,137,467 A 10/2000 Sheridon et al.
6,144,361 A 11/2000 Gordon, II et al.
6,147,791 A 11/2000 Sheridon
6,172,798 B1 1/2001 Albert et al.
6,184,856 B1 2/2001 Gordon, II et al.
6,225,971 B1 5/2001 Gordon, II et al.
6,241,921 B1 6/2001 Jacobson et al.
6,271,823 B1 8/2001 Gordon, II et al.
6,301,038 B1 10/2001 Fitzmaurice et al.
6,445,489 B1 9/2002 Jacobson et al.
6,504,524 B1 1/2003 Gates et al.
(Continued)

OTHER PUBLICATIONS

Wood, D., "An Electrochromic Renaissance?" Information Display, 18(3), Mar. 24, 2002.

(Continued)

*Primary Examiner* — Priyank J Shah
(74) *Attorney, Agent, or Firm* — Zhen Bao

(57) ABSTRACT

Methods for driving electro-optic displays including updating a first portion of the display using a drive scheme, the drive scheme configured to display white text on a black background; performing a time delay subsequent to the updating the first portion of the display; and updating a second portion of the display using the drive scheme to create a swiping motion across the display.

11 Claims, 8 Drawing Sheets

(56) References Cited

U.S. PATENT DOCUMENTS 6,512,354 B2 1/2003 Jacobson et al.
6,531,997 B1 3/2003 Gates et al.
6,672,921 B1 1/2004 Liang et al.
6,753,999 B2 6/2004 Zehner et al.
6,788,449 B2 9/2004 Liang et al.
6,825,970 B2 11/2004 Goenaga et al.
6,866,760 B2 3/2005 Paolini, Jr. et al.
6,870,657 B1 3/2005 Fitzmaurice et al.
6,900,851 B2 5/2005 Morrison et al.
6,922,276 B2 7/2005 Zhang et al.
6,950,220 B2 9/2005 Abramson et al.
6,982,178 B2 1/2006 LeCain et al.
6,995,550 B2 2/2006 Jacobson et al.
7,002,728 B2 2/2006 Pullen et al.
7,012,600 B2 3/2006 Zehner et al.
7,023,420 B2 4/2006 Comiskey et al.
7,034,783 B2 4/2006 Gates et al.
7,061,166 B2 6/2006 Kuniyasu
7,061,662 B2 6/2006 Chung et al.
7,072,095 B2 7/2006 Liang et al.
7,075,502 B1 7/2006 Drzaic et al.
7,116,318 B2 10/2006 Amundson et al.
7,116,466 B2 10/2006 Whitesides et al.
7,119,772 B2 10/2006 Amundson et al.
7,144,942 B2 12/2006 Zang et al.
7,170,670 B2 1/2007 Webber
7,177,066 B2 2/2007 Chung et al.
7,193,625 B2 3/2007 Danner et al.
7,202,847 B2 4/2007 Gates
7,236,291 B2 6/2007 Kaga et al.
7,242,514 B2 7/2007 Chung et al.
7,259,744 B2 8/2007 Arango et al.
7,304,787 B2 12/2007 Whitesides et al.
7,312,784 B2 12/2007 Baucom et al.
7,312,794 B2 12/2007 Zehner et al.
7,321,459 B2 1/2008 Masuda et al.
7,327,511 B2 2/2008 Whitesides et al.
7,348,951 B2 3/2008 Aoki
7,408,699 B2 8/2008 Wang et al.
7,411,719 B2 8/2008 Paolini, Jr. et al.
7,420,549 B2 9/2008 Jacobson et al.
7,453,445 B2 11/2008 Amundson
7,492,339 B2 2/2009 Amundson
7,528,822 B2 5/2009 Amundson et al.
7,535,624 B2 5/2009 Amundson et al.
7,545,358 B2 6/2009 Gates et al.
7,583,251 B2 9/2009 Arango et al.
7,602,374 B2 10/2009 Zehner et al.
7,612,760 B2 11/2009 Kawai
7,679,599 B2 3/2010 Kawai
7,679,813 B2 3/2010 Liang et al.
7,679,814 B2 3/2010 Paolini, Jr. et al.
7,683,606 B2 3/2010 Kang et al.
7,688,297 B2 3/2010 Zehner et al.
7,715,088 B2 5/2010 Liang et al.
7,729,039 B2 6/2010 LeCain et al.
7,733,311 B2 6/2010 Amundson et al.
7,733,335 B2 6/2010 Zehner et al.
7,787,169 B2 8/2010 Abramson et al.
7,839,564 B2 11/2010 Whitesides et al.
7,859,742 B1 12/2010 Chiu et al.
7,952,557 B2 5/2011 Amundson
7,956,841 B2 6/2011 Albert et al.
7,982,479 B2 7/2011 Wang et al.
7,999,787 B2 8/2011 Amundson et al.
8,009,348 B2 8/2011 Zehner et al.
8,077,141 B2 12/2011 Duthaler et al.
8,125,501 B2 2/2012 Amundson et al.
8,139,050 B2 3/2012 Jacobson et al.
8,174,490 B2 5/2012 Whitesides et al.
8,243,013 B1 8/2012 Sprague et al.
8,274,472 B1 9/2012 Wang et al.
8,289,250 B2 10/2012 Zehner et al.
8,300,006 B2 10/2012 Zhou et al.
8,305,341 B2 11/2012 Arango et al.
8,314,784 B2 11/2012 Ohkami et al.
8,373,649 B2 2/2013 Low et al.
8,384,658 B2 2/2013 Albert et al.
8,456,414 B2 6/2013 Lin et al.
8,462,102 B2 6/2013 Wong et al.
8,514,168 B2 8/2013 Chung et al.
8,537,105 B2 9/2013 Chiu et al.
8,558,783 B2 10/2013 Wilcox et al.
8,558,785 B2 10/2013 Zehner et al.
8,558,786 B2 10/2013 Lin
8,558,855 B2 10/2013 Sprague et al.
8,576,164 B2 11/2013 Sprague et al.
8,576,259 B2 11/2013 Lin et al.
8,593,396 B2 11/2013 Amundson et al.
8,605,032 B2 12/2013 Liu et al.
8,643,595 B2 2/2014 Chung et al.
8,665,206 B2 3/2014 Lin et al.
8,681,191 B2 3/2014 Yang et al.
8,717,280 B2 5/2014 de Zeeuw
8,730,153 B2 5/2014 Sprague et al.
8,810,525 B2 8/2014 Sprague
8,928,562 B2 1/2015 Gates et al.
8,928,641 B2 1/2015 Chiu et al.
8,976,444 B2 3/2015 Zhang et al.
8,982,108 B2 3/2015 Lee et al.
9,013,394 B2 4/2015 Lin
9,019,197 B2 4/2015 Lin
9,019,198 B2 4/2015 Lin et al.
9,019,318 B2 4/2015 Sprague et al.
9,082,352 B2 7/2015 Cheng et al.
9,171,508 B2 10/2015 Sprague et al.
9,218,773 B2 12/2015 Sun et al.
9,224,338 B2 12/2015 Chan et al.
9,224,342 B2 12/2015 Sprague et al.
9,224,344 B2 12/2015 Chung et al.
9,230,492 B2 1/2016 Harrington et al.
9,251,736 B2 2/2016 Lin et al.
9,262,973 B2 2/2016 Wu et al.
9,269,311 B2 2/2016 Amundson
9,279,906 B2 3/2016 Kang
9,299,294 B2 3/2016 Lin et al.
9,373,289 B2 6/2016 Sprague et al.
9,390,066 B2 7/2016 Smith et al.
9,390,661 B2 7/2016 Chiu et al.
9,412,314 B2 8/2016 Amundson et al.
9,460,666 B2 10/2016 Sprague et al.
9,483,981 B2 11/2016 Letouneur et al.
9,495,918 B2 11/2016 Harrington et al.
9,513,743 B2 12/2016 Sjodin et al.
9,514,667 B2 12/2016 Lin
9,542,895 B2 1/2017 Gates et al.
9,564,088 B2 2/2017 Wilcox et al.
9,564,104 B1 2/2017 Letoutneur et al.
9,612,502 B2 4/2017 Danner et al.
9,620,048 B2 4/2017 Sim et al.
9,672,766 B2 6/2017 Sjodin
9,691,333 B2 6/2017 Cheng et al.
9,721,495 B2 8/2017 Harrington et al.
9,792,861 B2 10/2017 Chang et al.
9,792,862 B2 10/2017 Hung et al.
9,904,500 B2 2/2018 Durlach
9,966,018 B2 5/2018 Gates et al.
10,319,313 B2 6/2019 Harris et al.
10,444,553 B2 10/2019 Laxton
10,852,568 B2 12/2020 Crounse et al.
2003/0102858 A1 6/2003 Jacobson et al.
2004/0246562 A1 12/2004 Chung et al.
2005/0253777 A1 11/2005 Zehner et al.
2007/0103427 A1 5/2007 Zhou et al.
2007/0176912 A1 8/2007 Beames et al.
2008/0024429 A1 1/2008 Zehner
2008/0024482 A1 1/2008 Gates et al.
2008/0136774 A1 6/2008 Harris et al.
2008/0303780 A1 12/2008 Sprague et al.
2009/0174651 A1 7/2009 Jacobson et al.
2009/0322721 A1 12/2009 Zehner et al.
2010/0110112 A1 5/2010 Nakanishi
2010/0194789 A1 8/2010 Lin et al.
2010/0220121 A1 9/2010 Zehner et al.

(56) References Cited

U.S. PATENT DOCUMENTS

| | | | | |
|---|---|---|---|---|
| 2010/0265561 | A1 | 10/2010 | Gates et al. | |
| 2011/0063314 | A1 | 3/2011 | Chiu et al. | |
| 2011/0175875 | A1 | 7/2011 | Lin et al. | |
| 2011/0193840 | A1 | 8/2011 | Amundson et al. | |
| 2011/0193841 | A1 | 8/2011 | Amundson et al. | |
| 2011/0199671 | A1 | 8/2011 | Amundson et al. | |
| 2011/0221740 | A1 | 9/2011 | Yang et al. | |
| 2012/0001957 | A1 | 1/2012 | Liu et al. | |
| 2012/0098740 | A1 | 4/2012 | Chiu et al. | |
| 2013/0063333 | A1 | 3/2013 | Arango et al. | |
| 2013/0249782 | A1 | 9/2013 | Wu et al. | |
| 2014/0009817 | A1 | 1/2014 | Wilcox et al. | |
| 2014/0204012 | A1 | 7/2014 | Wu et al. | |
| 2014/0240210 | A1 | 8/2014 | Wu et al. | |
| 2014/0253425 | A1 | 9/2014 | Zalesky et al. | |
| 2014/0293398 | A1 | 10/2014 | Wang et al. | |
| 2015/0005720 | A1 | 1/2015 | Zang | |
| 2015/0262255 | A1 | 9/2015 | Khajehnouri et al. | |
| 2015/0370339 | A1* | 12/2015 | Ligtenberg | G06F 1/1662 345/168 |
| 2016/0012710 | A1 | 1/2016 | Lu et al. | |
| 2016/0140910 | A1 | 5/2016 | Amundson | |
| 2016/0225322 | A1* | 8/2016 | Sim | G09G 5/024 |
| 2017/0148372 | A1* | 5/2017 | Emelie | G09G 3/2044 |
| 2018/0252980 | A1* | 9/2018 | Crounse | G02F 1/0018 |
| 2018/0286319 | A1* | 10/2018 | Emelie | G09G 3/344 |
| 2018/0307776 | A1 | 10/2018 | Ferradini et al. | |

OTHER PUBLICATIONS

O'Regan, B. et al., "A Low Cost, High-efficiency Solar Cell Based on Dye-sensitized colloidal TiO2 Films", Nature, vol. 353, pp. 737-740 (Oct. 24, 1991).

Bach, Udo. et al., "Nanomaterials-Based Electrochromics for Paper-Quality Displays", Adv. Mater, vol. 14, No. 11, pp. 845-848, (Jun. 5, 2002).

Hayes, R.A. et al., "Video-Speed Electronic Paper Based on Electrowetting", Nature, vol. 425, No. 25, pp. 383-385 (Sep. 2003).

Kitamura, T. et al., "Electrical toner movement for electronic paper-like display", Asia Display/IDW '01, pp. 1517-1520, Paper HCS1-1 (2001).

Yamaguchi, Y. et al., "Toner display using insulative particles charged triboelectrically", Asia Display/IDW '01, pp. 1729-1730, Paper AMD4-4 (2001).

Korean Intellectual Property Office, PCT/US2020/060368, International Search Report and Written Opinion, dated Feb. 26, 2021.

* cited by examiner

METHODS FOR DRIVING ELECTRO-OPTIC DISPLAYS

REFERENCE TO RELATED APPLICATIONS

This application is related to and claims priority to U.S. Provisional Application 62/935,175 filed on Nov. 14, 2019.

The entire disclosures of the aforementioned application is herein incorporated by reference.

SUBJECT OF THE INVENTION

This invention relates to methods for driving electro-optic displays. More specifically, this invention relates to driving methods for reducing pixel edge artifacts and/or image retentions in electro-optic displays.

BACKGROUND

Electro-optic displays typically have a backplane provided with a plurality of pixel electrodes each of which defines one pixel of the display; conventionally, a single common electrode extending over a large number of pixels, and normally the whole display is provided on the opposed side of the electro-optic medium. The individual pixel electrodes may be driven directly (i.e., a separate conductor may be provided to each pixel electrode) or the pixel electrodes may be driven in an active matrix manner which will be familiar to those skilled in backplane technology. Since adjacent pixel electrodes will often be at different voltages, they must be separated by inter-pixel gaps of finite width in order to avoid electrical shorting between electrodes. Although at first glance it might appear that the electro-optic medium overlying these gaps would not switch when drive voltages are applied to the pixel electrodes (and indeed, this is often the case with some non-bistable electro-optic media, such as liquid crystals, where a black mask is typically provided to hide these non-switching gaps), in the case of many bistable electro-optic media the medium overlying the gap does switch because of an edge artifact phenomenon known as "blooming".

Blooming refers to the tendency for application of a drive voltage to a pixel electrode to cause a change in the optical state of the electro-optic medium over an area larger than the physical size of the pixel electrode. Although excessive blooming should be avoided (for example, in a high resolution active matrix display one does not wish application of a drive voltage to a single pixel to cause switching over an area covering several adjacent pixels, since this would reduce the effective resolution of the display) a controlled amount of blooming is often useful. For example, consider a black-on-white electro-optic display which displays numbers using a conventional seven-segment array of seven directly driven pixel electrodes for each digit. When, for example, a zero is displayed, six segments are turned black. In the absence of blooming, the six inter-pixel gaps will be visible. However, by providing a controlled amount of blooming, for example as described in the U.S. Pat. No. 7,602,374, which is incorporated herein in its entirety, the inter-pixel gaps can be made to turn black, resulting in a more visually pleasing digit. However, blooming can lead to a problem denoted "edge ghosting".

An area of blooming is not a uniform white or black but is typically a transition zone where, as one moves across the area of blooming, the color of the medium transitions from white through various shades of gray to black. Accordingly, an edge ghost will typically be an area of varying shades of gray rather than a uniform gray area, but can still be visible and objectionable, especially since the human eye is well equipped to detect areas of gray in monochrome images where each pixel is supposed to be pure black or pure white.) In some cases, asymmetric blooming may contribute to edge ghosting. "Asymmetric blooming" refers to a phenomenon whereby in some electro-optic media (for example, the copper chromite/titania encapsulated electrophoretic media described in U.S. Pat. No. 7,002,728) the blooming is "asymmetric" in the sense that more blooming occurs during a transition from one extreme optical state of a pixel to the other extreme optical state than during a transition in the reverse direction; in the media described in this patent; typically the blooming during a black-to-white transition is greater than that during a white-to-black one.

As such, driving methods that reduces the ghosting or blooming effects are needed.

SUMMARY OF INVENTION

This invention provides a method for driving electro-optic displays, the method includes updating a first portion of the display using a drive scheme, the drive scheme configured to display white text on a black background; performing a time delay subsequent to the updating the first portion of the display; and updating a second portion of the display using the drive scheme to create a swiping motion across the display. In some embodiments, the driving method further comprising removing edge artifacts from display pixels.

DETAILED DESCRIPTION

Figure 1:
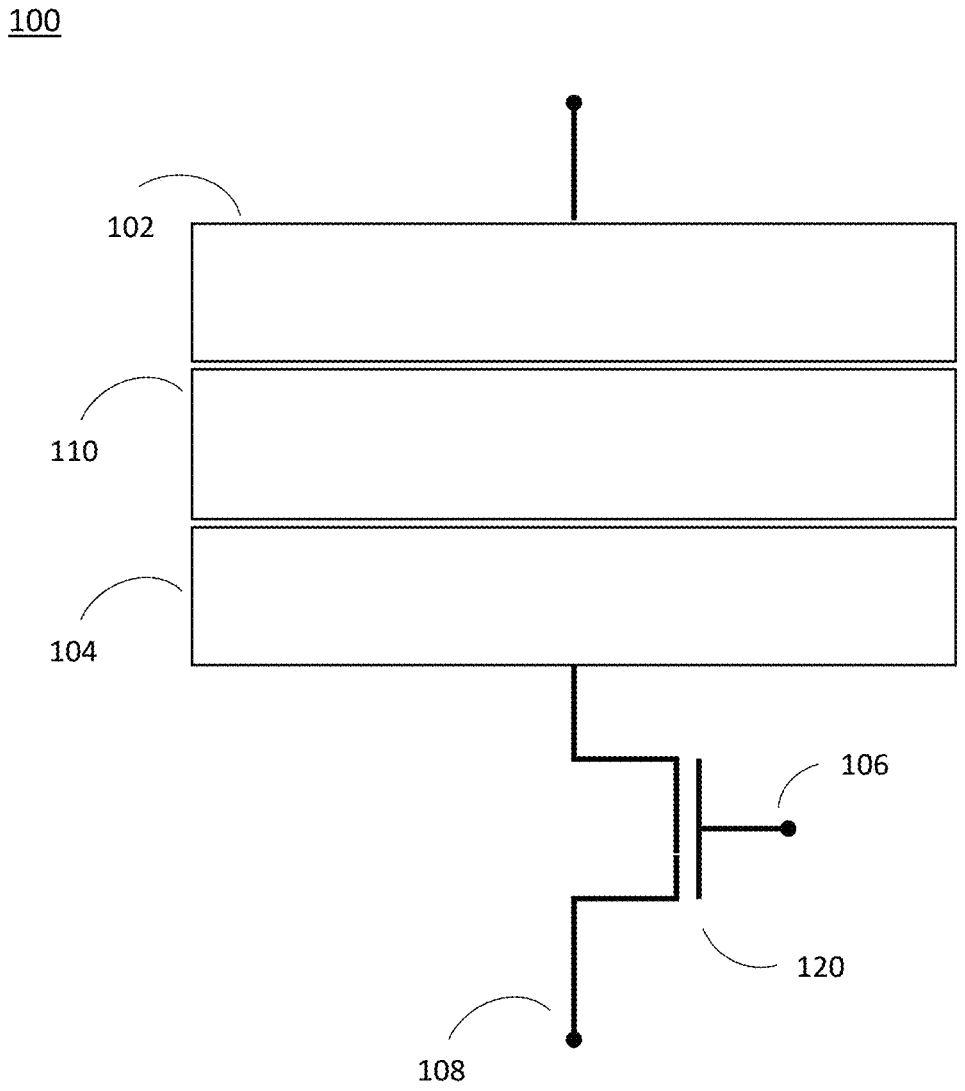
FIG. 1 is a circuit diagram representing an electrophoretic display.

The present invention relates to methods for driving electro-optic displays, especially bistable electro-optic displays, and to apparatus for use in such methods. More specifically, this invention relates to driving methods which may allow for reduced "ghosting" and edge effects, and reduced flashing in such displays. This invention is especially, but not exclusively, intended for use with particle-based electrophoretic displays in which one or more types of electrically charged particles are present in a fluid and are moved through the fluid under the influence of an electric field to change the appearance of the display.

The term "electro-optic", as applied to a material or a display, is used herein in its conventional meaning in the imaging art to refer to a material having first and second display states differing in at least one optical property, the material being changed from its first to its second display state by application of an electric field to the material. Although the optical property is typically color perceptible to the human eye, it may be another optical property, such as optical transmission, reflectance, luminescence or, in the case of displays intended for machine reading, pseudo-color in the sense of a change in reflectance of electromagnetic wavelengths outside the visible range.

The term "gray state" is used herein in its conventional meaning in the imaging art to refer to a state intermediate two extreme optical states of a pixel, and does not necessarily imply a black-white transition between these two extreme states. For example, several of the E Ink patents and published applications referred to below describe electrophoretic displays in which the extreme states are white and deep blue, so that an intermediate "gray state" would actually be pale blue. Indeed, as already mentioned, the change in optical state may not be a color change at all. The terms "black" and "white" may be used hereinafter to refer to the two extreme optical states of a display, and should be understood as normally including extreme optical states which are not strictly black and white, for example, the aforementioned white and dark blue states. The term "monochrome" may be used hereinafter to denote a drive scheme which only drives pixels to their two extreme optical states with no intervening gray states.

Some electro-optic materials are solid in the sense that the materials have solid external surfaces, although the materials may, and often do, have internal liquid- or gas-filled spaces. Such displays using solid electro-optic materials may hereinafter for convenience be referred to as "solid electro-optic displays". Thus, the term "solid electro-optic displays" includes rotating bichromal member displays, encapsulated electrophoretic displays, microcell electrophoretic displays and encapsulated liquid crystal displays.

The terms "bistable" and "bistability" are used herein in their conventional meaning in the art to refer to displays comprising display elements having first and second display states differing in at least one optical property, and such that after any given element has been driven, by means of an addressing pulse of finite duration, to assume either its first or second display state, after the addressing pulse has terminated, that state will persist for at least several times, for example at least four times, the minimum duration of the addressing pulse required to change the state of the display element. It is shown in U.S. Pat. No. 7,170,670 that some particle-based electrophoretic displays capable of gray scale are stable not only in their extreme black and white states but also in their intermediate gray states, and the same is true of some other types of electro-optic displays. This type of display is properly called "multi-stable" rather than bistable, although for convenience the term "bistable" may be used herein to cover both bistable and multi-stable displays.

The term "impulse" is used herein in its conventional meaning of the integral of voltage with respect to time. However, some bistable electro-optic media act as charge transducers, and with such media an alternative definition of impulse, namely the integral of current over time (which is equal to the total charge applied) may be used. The appropriate definition of impulse should be used, depending on whether the medium acts as a voltage-time impulse transducer or a charge impulse transducer.

Much of the discussion below will focus on methods for driving one or more pixels of an electro-optic display through a transition from an initial gray level to a final gray level (which may or may not be different from the initial gray level). The term "waveform" will be used to denote the entire voltage against time curve used to effect the transition from one specific initial gray level to a specific final gray level. Typically such a waveform will comprise a plurality of waveform elements; where these elements are essentially rectangular (i.e., where a given element comprises application of a constant voltage for a period of time); the elements may be called "pulses" or "drive pulses". The term "drive scheme" denotes a set of waveforms sufficient to effect all possible transitions between gray levels for a specific display. A display may make use of more than one drive scheme; for example, the U.S. Pat. No. 7,012,600, which is incorporated herein in its entirety, teaches that a drive scheme may need to be modified depending upon parameters such as the temperature of the display or the time for which it has been in operation during its lifetime, and thus a display may be provided with a plurality of different drive schemes to be used at differing temperature etc. A set of drive schemes used in this manner may be referred to as "a set of related drive schemes." It is also possible, as described in several of the aforementioned MEDEOD applications, to use more than one drive scheme simultaneously in different areas of the same display, and a set of drive schemes used in this manner may be referred to as "a set of simultaneous drive schemes."

Several types of electro-optic displays are known. One type of electro-optic display is a rotating bichromal member type as described, for example, in U.S. Pat. Nos. 5,808,783; 5,777,782; 5,760,761; 6,054,071 6,055,091; 6,097,531; 6,128,124; 6,137,467; and 6,147,791 (although this type of display is often referred to as a "rotating bichromal ball" display, the term "rotating bichromal member" is preferred as more accurate since in some of the patents mentioned above the rotating members are not spherical). Such a display uses a large number of small bodies (typically spherical or cylindrical) which have two or more sections with differing optical characteristics, and an internal dipole. These bodies are suspended within liquid-filled vacuoles within a matrix, the vacuoles being filled with liquid so that the bodies are free to rotate. The appearance of the display is changed by applying an electric field thereto, thus rotating the bodies to various positions and varying which of the sections of the bodies is seen through a viewing surface. This type of electro-optic medium is typically bistable.

Another type of electro-optic display uses an electrochromic medium, for example an electrochromic medium in the form of a nanochromic film comprising an electrode formed at least in part from a semi-conducting metal oxide and a plurality of dye molecules capable of reversible color change attached to the electrode; see, for example O'Regan, B., et al., Nature 1991, 353, 737; and Wood, D., Information Display, 18(3), 24 (March 2002). See also Bach, U., et al., Adv. Mater., 2002, 14(11), 845. Nanochromic films of this type are also described, for example, in U.S. Pat. Nos. 6,301,038; 6,870,657; and 6,950,220. This type of medium is also typically bistable.

Another type of electro-optic display is an electro-wetting display developed by Philips and described in Hayes, R. A., et al., "Video-Speed Electronic Paper Based on Electrowetting", Nature, 425, 383-385 (2003). It is shown in U.S. Pat. No. 7,420,549 that such electro-wetting displays can be made bistable.

One type of electro-optic display, which has been the subject of intense research and development for a number of years, is the particle-based electrophoretic display, in which a plurality of charged particles move through a fluid under the influence of an electric field. Electrophoretic displays can have attributes of good brightness and contrast, wide viewing angles, state bistability, and low power consumption when compared with liquid crystal displays. Nevertheless, problems with the long-term image quality of these displays have prevented their widespread usage. For example, particles that make up electrophoretic displays tend to settle, resulting in inadequate service-life for these displays.

As noted above, electrophoretic media require the presence of a fluid. In most prior art electrophoretic media, this fluid is a liquid, but electrophoretic media can be produced using gaseous fluids; see, for example, Kitamura, T., et al., "Electrical toner movement for electronic paper-like display", IDW Japan, 2001, Paper HCS1-1, and Yamaguchi, Y., et al., "Toner display using insulative particles charged triboelectrically", IDW Japan, 2001, Paper AMD4-4). See also U.S. Pat. Nos. 7,321,459 and 7,236,291. Such gas-based electrophoretic media appear to be susceptible to the same types of problems due to particle settling as liquid-based electrophoretic media, when the media are used in an orientation which permits such settling, for example in a sign where the medium is disposed in a vertical plane. Indeed, particle settling appears to be a more serious problem in gas-based electrophoretic media than in liquid-based ones, since the lower viscosity of gaseous suspending fluids as compared with liquid ones allows more rapid settling of the electrophoretic particles.

Numerous patents and applications assigned to or in the names of the Massachusetts Institute of Technology (MIT) and E Ink Corporation describe various technologies used in encapsulated electrophoretic and other electro-optic media. Such encapsulated media comprise numerous small capsules, each of which itself comprises an internal phase containing electrophoretically-mobile particles in a fluid medium, and a capsule wall surrounding the internal phase. Typically, the capsules are themselves held within a polymeric binder to form a coherent layer positioned between two electrodes. The technologies described in these patents and applications include:

(a) Electrophoretic particles, fluids and fluid additives; see for example U.S. Pat. Nos. 7,002,728 and 7,679,814;

(b) Capsules, binders and encapsulation processes; see for example U.S. Pat. Nos. 6,922,276 and 7,411,719;

(c) Microcell structures, wall materials, and methods of forming microcells; see for example U.S. Pat. Nos. 7,072,095 and 9,279,906;

(d) Methods for filling and sealing microcells; see for example U.S. Pat. Nos. 7,144,942 and 7,715,088;

(e) Films and sub-assemblies containing electro-optic materials; see for example U.S. Pat. Nos. 6,982,178 and 7,839,564;

(f) Backplanes, adhesive layers and other auxiliary layers and methods used in displays; see for example U.S. Pat. Nos. 7,116,318 and 7,535,624;

(g) Color formation and color adjustment; see for example U.S. Pat. Nos. 7,075,502 and 7,839,564.

(h) Applications of displays; see for example U.S. Pat. Nos. 7,312,784; 8,009,348;

(i) Non-electrophoretic displays, as described in U.S. Pat. No. 6,241,921 and U.S. Patent Application Publication No. 2015/0277160; and applications of encapsulation and microcell technology other than displays; see for example U.S. Patent Application Publications Nos. 2015/0005720 and 2016/0012710; and (j) Methods for driving displays; see for example U.S. Pat. Nos. 5,930,026; 6,445,489; 6,504,524; 6,512,354; 6,531,997; 6,753,999; 6,825,970; 6,900,851; 6,995,550; 7,012,600; 7,023,420; 7,034,783; 7,061,166; 7,061,662; 7,116,466; 7,119,772; 7,177,066; 7,193,625; 7,202,847; 7,242,514; 7,259,744; 7,304,787; 7,312,794; 7,327,511; 7,408,699; 7,453,445; 7,492,339; 7,528,822; 7,545,358; 7,583,251; 7,602,374; 7,612,760; 7,679,599; 7,679,813; 7,683,606; 7,688,297; 7,729,039; 7,733,311; 7,733,335; 7,787,169; 7,859,742; 7,952,557; 7,956,841; 7,982,479; 7,999,787; 8,077,141; 8,125,501; 8,139,050; 8,174,490; 8,243,013; 8,274,472; 8,289,250; 8,300,006; 8,305,341; 8,314,784; 8,373,649; 8,384,658; 8,456,414; 8,462,102; 8,537,105; 8,558,783; 8,558,785; 8,558,786; 8,558,855; 8,576,164; 8,576,259; 8,593,396; 8,605,032; 8,643,595; 8,665,206; 8,681,191; 8,730,153; 8,810,525; 8,928,562; 8,928,641; 8,976,444; 9,013,394; 9,019,197; 9,019,198; 9,019,318; 9,082,352; 9,171,508; 9,218,773; 9,224,338; 9,224,342; 9,224,344; 9,230,492; 9,251,736; 9,262,973; 9,269,311; 9,299,294; 9,373,289; 9,390,066; 9,390,661; and 9,412,314; and U.S. Patent Applications Publication Nos. 2003/0102858; 2004/0246562; 2005/0253777; 2007/0070032; 2007/0076289; 2007/0091418; 2007/0103427; 2007/0176912; 2007/0296452; 2008/0024429; 2008/0024482; 2008/0136774; 2008/0169821; 2008/0218471; 2008/0291129; 2008/0303780; 2009/0174651; 2009/0195568; 2009/0322721; 2010/0194733; 2010/0194789; 2010/0220121; 2010/0265561; 2010/0283804; 2011/0063314; 2011/0175875; 2011/0193840; 2011/0193841; 2011/0199671; 2011/0221740; 2012/0001957; 2012/0098740; 2013/0063333; 2013/0194250; 2013/0249782; 2013/0321278; 2014/0009817; 2014/0085355; 2014/0204012; 2014/0218277; 2014/0240210; 2014/0240373; 2014/0253425; 2014/0292830; 2014/0293398; 2014/0333685; 2014/0340734; 2015/0070744; 2015/0097877; 2015/0109283; 2015/0213749; 2015/0213765; 2015/0221257; 2015/0262255; 2016/0071465; 2016/0078820; 2016/0093253; 2016/0140910; and 2016/0180777.

Many of the aforementioned patents and applications recognize that the walls surrounding the discrete microcapsules in an encapsulated electrophoretic medium could be replaced by a continuous phase, thus producing a so-called polymer-dispersed electrophoretic display, in which the electrophoretic medium comprises a plurality of discrete droplets of an electrophoretic fluid and a continuous phase of a polymeric material, and that the discrete droplets of electrophoretic fluid within such a polymer-dispersed electrophoretic display may be regarded as capsules or microcapsules even though no discrete capsule membrane is associated with each individual droplet; see for example, the aforementioned 2002/0131147. Accordingly, for purposes of the present application, such polymer-dispersed electrophoretic media are regarded as sub-species of encapsulated electrophoretic media.

A related type of electrophoretic display is a so-called "microcell electrophoretic display." In a microcell electrophoretic display, the charged particles and the suspending fluid are not encapsulated within microcapsules but instead are retained within a plurality of cavities formed within a carrier medium, e.g., a polymeric film. See, for example, International Application Publication No. WO 02/01281, and published U.S. Application No. 2002/0075556, both assigned to Sipix Imaging, Inc.

Many of the aforementioned E Ink and MIT patents and applications also contemplate microcell electrophoretic displays and polymer-dispersed electrophoretic displays. The term "encapsulated electrophoretic displays" can refer to all such display types, which may also be described collectively as "microcavity electrophoretic displays" to generalize across the morphology of the walls.

Another type of electro-optic display is an electro-wetting display developed by Philips and described in Hayes, R. A., et al., "Video-Speed Electronic Paper Based on Electrowetting," Nature, 425, 383-385 (2003). It is shown in copending application Ser. No. 10/711,802, filed Oct. 6, 2004, that such electro-wetting displays can be made bistable.

Other types of electro-optic materials may also be used. Of particular interest, bistable ferroelectric liquid crystal displays (FLCs) are known in the art and have exhibited remnant voltage behavior.

Although electrophoretic media may be opaque (since, for example, in many electrophoretic media, the particles substantially block transmission of visible light through the display) and operate in a reflective mode, some electrophoretic displays can be made to operate in a so-called "shutter mode" in which one display state is substantially opaque and one is light-transmissive. See, for example, the patents U.S. Pat. Nos. 6,130,774 and 6,172,798, and 5,872,552; 6,144,361; 6,271,823; 6,225,971; and 6,184,856. Dielectrophoretic displays, which are similar to electrophoretic displays but rely upon variations in electric field strength, can operate in a similar mode; see U.S. Pat. No. 4,418,346. Other types of electro-optic displays may also be capable of operating in shutter mode.

A high-resolution display may include individual pixels which are addressable without interference from adjacent pixels. One way to obtain such pixels is to provide an array of non-linear elements, such as transistors or diodes, with at least one non-linear element associated with each pixel, to produce an "active matrix" display. An addressing or pixel electrode, which addresses one pixel, is connected to an appropriate voltage source through the associated non-linear element. When the non-linear element is a transistor, the pixel electrode may be connected to the drain of the transistor, and this arrangement will be assumed in the following description, although it is essentially arbitrary and the pixel electrode could be connected to the source of the transistor. In high-resolution arrays, the pixels may be arranged in a two-dimensional array of rows and columns, such that any specific pixel is uniquely defined by the intersection of one specified row and one specified column. The sources of all the transistors in each column may be connected to a single column electrode, while the gates of all the transistors in each row may be connected to a single row electrode; again the assignment of sources to rows and gates to columns may be reversed if desired.

The display may be written in a row-by-row manner. The row electrodes are connected to a row driver, which may apply to a selected row electrode a voltage such as to ensure that all the transistors in the selected row are conductive, while applying to all other rows a voltage such as to ensure that all the transistors in these non-selected rows remain non-conductive. The column electrodes are connected to column drivers, which place upon the various column electrodes voltages selected to drive the pixels in a selected row to their desired optical states. (The aforementioned voltages are relative to a common front electrode which may be provided on the opposed side of the electro-optic medium from the non-linear array and extends across the whole display. As in known in the art, voltage is relative and a measure of a charge differential between two points. One voltage value is relative to another voltage value. For example, zero voltage ("0V") refers to having no voltage differential relative to another voltage.) After a pre-selected interval known as the "line address time," a selected row is deselected, another row is selected, and the voltages on the column drivers are changed so that the next line of the display is written.

However, in use, certain waveforms may produce a remnant voltage to pixels of an electro-optic display, and as evident from the discussion above, this remnant voltage produces several unwanted optical effects and is in general undesirable.

As presented herein, a "shift" in the optical state associated with an addressing pulse refers to a situation in which a first application of a particular addressing pulse to an electro-optic display results in a first optical state (e.g., a first gray tone), and a subsequent application of the same addressing pulse to the electro-optic display results in a second optical state (e.g., a second gray tone). Remnant voltages may give rise to shifts in the optical state because the voltage applied to a pixel of the electro-optic display during application of an addressing pulse includes the sum of the remnant voltage and the voltage of the addressing pulse.

A "drift" in the optical state of a display over time refers to a situation in which the optical state of an electro-optic display changes while the display is at rest (e.g., during a period in which an addressing pulse is not applied to the display). Remnant voltages may give rise to drifts in the optical state because the optical state of a pixel may depend on the pixel's remnant voltage, and a pixel's remnant voltage may decay over time.

As discussed above, "ghosting" refers to a situation in which, after the electro-optic display has been rewritten, traces of the previous image(s) are still visible. Remnant voltages may give rise to "edge ghosting," a type of ghosting in which an outline (edge) of a portion of a previous image remains visible.

An Exemplary EPD

FIG. 1 shows a schematic of a pixel 100 of an electro-optic display in accordance with the subject matter submitted herein. Pixel 100 may include an imaging film 110. In some embodiments, imaging film 110 may be bistable. In some embodiments, imaging film 110 may include, without limitation, an encapsulated electrophoretic imaging film, which may include, for example, charged pigment particles.

Imaging film 110 may be disposed between a front electrode 102 and a rear electrode 104. Front electrode 102 may be formed between the imaging film and the front of the display. In some embodiments, front electrode 102 may be transparent. In some embodiments, front electrode 102 may be formed of any suitable transparent material, including, without limitation, indium tin oxide (ITO). Rear electrode 104 may be formed opposite a front electrode 102. In some embodiments, a parasitic capacitance (not shown) may be formed between front electrode 102 and rear electrode 104.

Pixel 100 may be one of a plurality of pixels. The plurality of pixels may be arranged in a two-dimensional array of rows and columns to form a matrix, such that any specific pixel is uniquely defined by the intersection of one specified row and one specified column. In some embodiments, the matrix of pixels may be an "active matrix," in which each pixel is associated with at least one non-linear circuit element 120. The non-linear circuit element 120 may be coupled between back-plate electrode 104 and an addressing electrode 108. In some embodiments, non-linear element 120 may include a diode and/or a transistor, including, without limitation, a MOSFET. The drain (or source) of the MOSFET may be coupled to back-plate electrode 104, the source (or drain) of the MOSFET may be coupled to addressing electrode 108, and the gate of the MOSFET may be coupled to a driver electrode 106 configured to control the activation and deactivation of the MOSFET. (For simplicity, the terminal of the MOSFET coupled to back-plate electrode 104 will be referred to as the MOSFET's drain, and the terminal of the MOSFET coupled to addressing electrode 108 will be referred to as the MOSFET's source. However, one of ordinary skill in the art will recognize that, in some embodiments, the source and drain of the MOSFET may be interchanged.)

In some embodiments of the active matrix, the addressing electrodes 108 of all the pixels in each column may be connected to a same column electrode, and the driver electrodes 106 of all the pixels in each row may be connected to a same row electrode. The row electrodes may be connected to a row driver, which may select one or more rows of pixels by applying to the selected row electrodes a voltage sufficient to activate the non-linear elements 120 of all the pixels 100 in the selected row(s). The column electrodes may be connected to column drivers, which may place upon the addressing electrode 106 of a selected (activated) pixel a voltage suitable for driving the pixel into a desired optical state. The voltage applied to an addressing electrode 108 may be relative to the voltage applied to the pixel's front-plate electrode 102 (e.g., a voltage of approximately zero volts). In some embodiments, the front-plate electrodes 102 of all the pixels in the active matrix may be coupled to a common electrode.

In some embodiments, the pixels 100 of the active matrix may be written in a row-by-row manner. For example, a row of pixels may be selected by the row driver, and the voltages corresponding to the desired optical states for the row of pixels may be applied to the pixels by the column drivers. After a pre-selected interval known as the "line address time," the selected row may be deselected, another row may be selected, and the voltages on the column drivers may be changed so that another line of the display is written.

Figure 2:
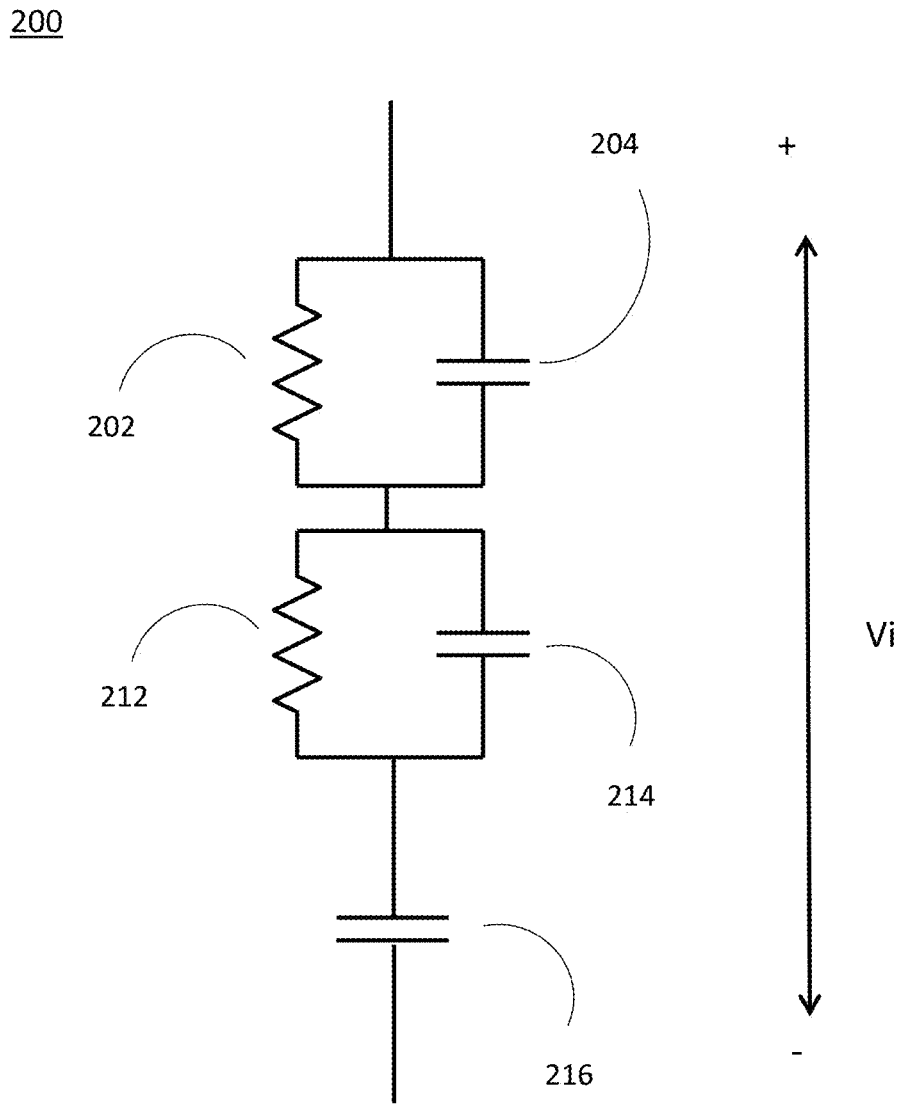
FIG. 2 shows a circuit model of the electro-optic imaging layer.

FIG. 2 shows a circuit model of the electro-optic imaging layer 110 disposed between the front electrode 102 and the rear electrode 104 in accordance with the subject matter presented herein. Resistor 202 and capacitor 204 may represent the resistance and capacitance of the electro-optic imaging layer 110, the front electrode 102 and the rear electrode 104, including any adhesive layers. Resistor 212 and capacitor 214 may represent the resistance and capacitance of a lamination adhesive layer. Capacitor 216 may represent a capacitance that may form between the front electrode 102 and the back electrode 104, for example, interfacial contact areas between layers, such as the interface between the imaging layer and the lamination adhesive layer and/or between the lamination adhesive layer and the back-plane electrode. A voltage Vi across a pixel's imaging film 110 may include the pixel's remnant voltage.

For some applications, an electro-optic display as presented in FIGS. 1 and 2 may be driven with a driving scheme where drive voltage is applied only to pixels that are undergoing a non-zero transition (i.e., a transition in which the initial and final gray levels differ from each other), but no drive voltage is applied during zero transitions (in which the initial and final gray levels are the same). In practice, such driving scheme may be designated as a "global limited" or "GL" drive scheme). A GL drive scheme is characterized by applying no drive voltages to pixels which are undergoing a zero transition (e.g., white-to-white or black-to-black), meaning, these pixels goes through zero or no optical transactions. In, for example, a display used as an electronic book reader, displaying white text on a black background (i.e., a dark mode operation) there are numerous black pixels, especially in the margins and between lines of text which remain unchanged from one page of text to the next; hence, not rewriting these black pixels substantially reduces the apparent "flashiness" of the display rewriting. Instead, only pixels going through active optical transactions are being updated.

Figure 3:
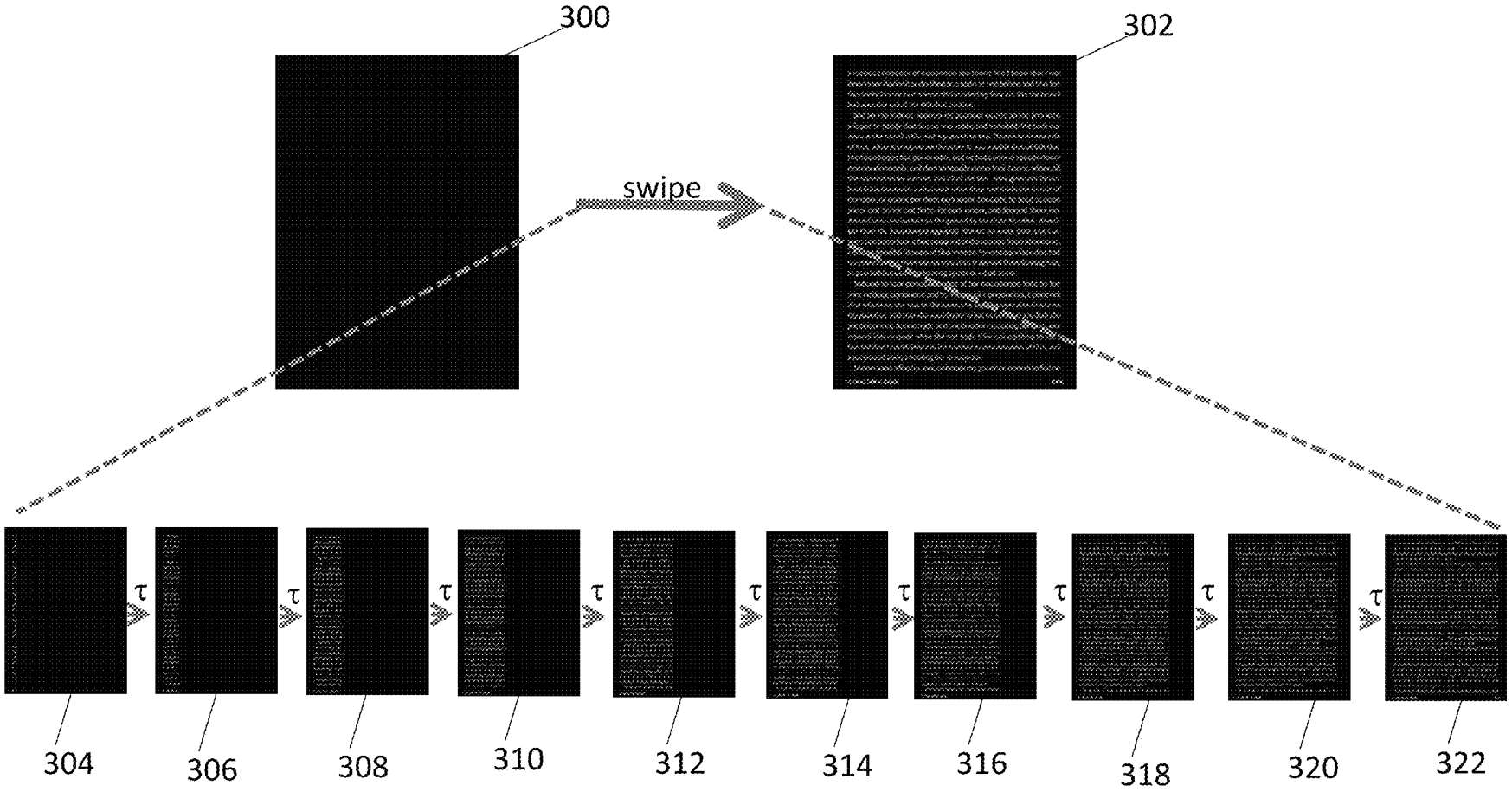
FIG. 3 illustrates a segmented swipe operation under dark mode.

Furthermore, in order to improve transition experience to be more fluid as an electro-optic display goes from one page to another, one method is to pipeline the update of the display in segments and do a short delay τ (e.g., 10 ms to 20 ms) from one segment to another. For example, the driving method presented herein firstly updates a first portion of a display (e.g., 304 of FIG. 3), using a drive scheme such as the GL drive scheme; then introduce or perform a time delay, followed by updating a second portion (e.g., 306 of FIG. 3) of the display, and in this manner, it gives an illusion of a motion as the page update. FIG. 3 shows a possible sequence of the segment-by-segment updating in dark mode. In this manner of updating, it will give an illusion of "swiping" the page. The direction of this "swipe" can be left to right, right to left, top to bottom or bottom to top can be infer by detecting the action of the user's input on the touch panel, giving the user an impression of control on the action of the display. As shown, the updating of the display from a complete black page 300 to the updated page 302 can occur through a series of segmented updates. Starting at a first segmented update 304, only a portion of the display is updated and a portion of the text is being displayed. Subsequently, after a short delay τ, a next segment 306 may be updated onto the display. The subsequent segments 308-322 may be updated onto the display at a similar fashion, with the short delay τ in between, until the display is completely updated. This method of updating can create an illusion of swiping a page, providing less flash compared to a single complete display update.

Figure 4:
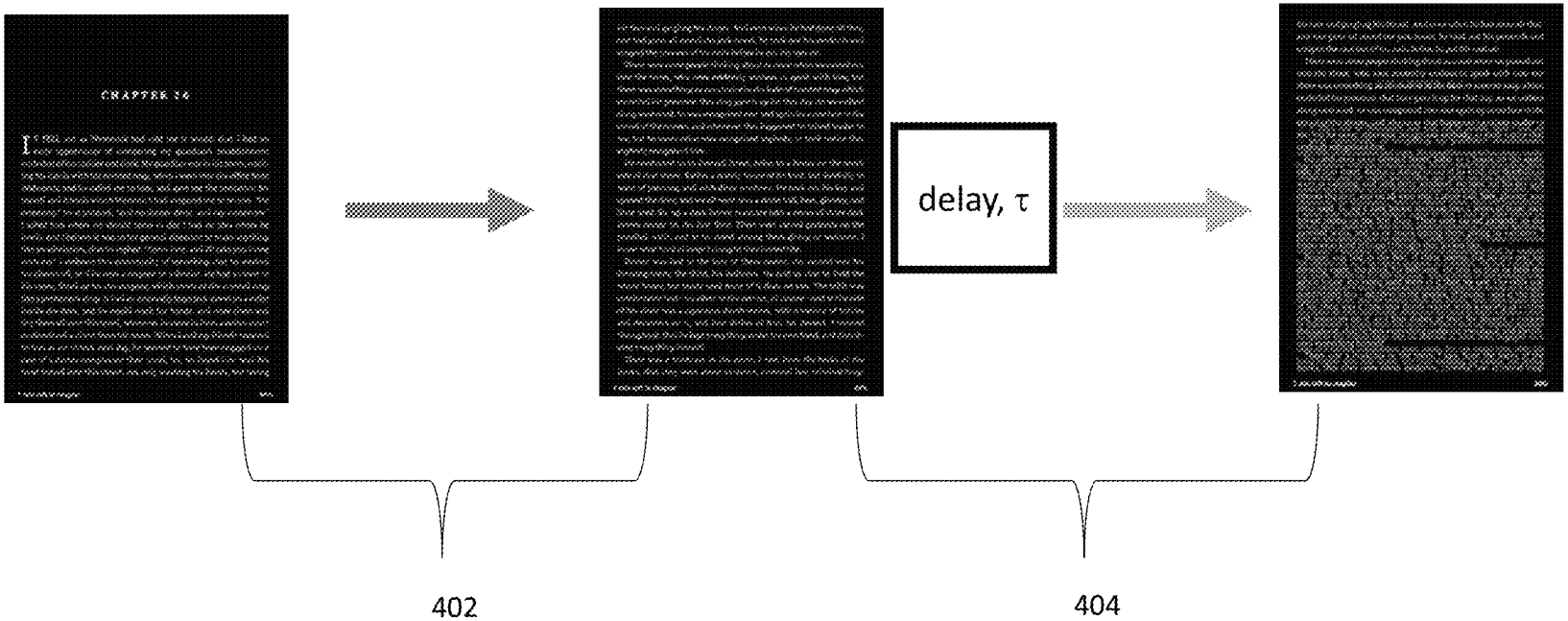
FIG. 4 illustrates a dark mode swipe operation with edge clearing.

When operating in dark mode and using a segmented and low flash drive scheme as described above, sometimes the driving or updating cycle may include two phases. In phase 1 402, one may perform the swiping action without any post drive discharge. And in phase 2 404, one may perform an edge clearing action as show in FIG. 4. In this setup, the phase 1 updating 402 may use a low flash, Global Limited (GL) drive scheme where the electro-optic display is updated through a multi-segmented swipe, as illustrated in FIG. 3. Alternatively, the electro-optic display may be updated with a single or 1 segment swipe. Subsequently, transitioning from a current image to a next image, an imaging algorithm may be used to identify and/or determine the pixels that will likely to develop blooming and/or edge artifacts. One example of a such algorithm is presented below:

```
For all pixel locations (i, j) in any order:
    If the currentpixels (i, j) is black and nextpixels (i, j) is black
        then assigns edgepixels (i, j) = nextpixels (i, j)
    Else if at least one cardinal neighbors of
        currentpixels (i, j) not black and nextpixels (i, j) of black,
        assigns edgepixels (i, j) = edgeclearstate
    Else if the currentpixels (i, j) is not black and
        nextpixels (i, j) is black and at least one cardinal neighbors
        of currentpixels (i, j) and nextpixels (i, j) of black, assigns
        edgepixels (i, j) = edgeclearstate
    Otherwise edgepixels (i, j) = nextpixels (i, j)
End
```

where

- nextpixels (i, j) denotes the next image pixel at location (i, j)
- currentpixels (i, j) denotes the current pixel at location (i, j)
- cardinal neighbors denotes the north, south and east, west neighbor -continued to a pixel
- edgeclearstate denotes the special edge clearing pixel state In practice, the above mentioned algorithm identifies and/or flags display pixels that will develop edge artifacts and apply an edge clearing waveform to these pixels. For example, for a particular display pixel, if at least one cardinal neighbors of this display pixel has a current optical state that is not black and a next optical state of black (i.e., the cardinal neighbor pixel is going through active optical transitions), this particular display pixel will deemed to be likely to develop edge artifact and will be flagged accordingly. And this particular display pixel will receive the edge clearing waveform in phase 2. Moreover, if a particular pixel has a current optical state that is not black and a next optical state that is black, and at least one cardinal neighbor pixel with a black current optical state and black next optical state, then this particular display pixel will be deemed likely to develop edge artifact and is flagged accordingly.

Figure 5:
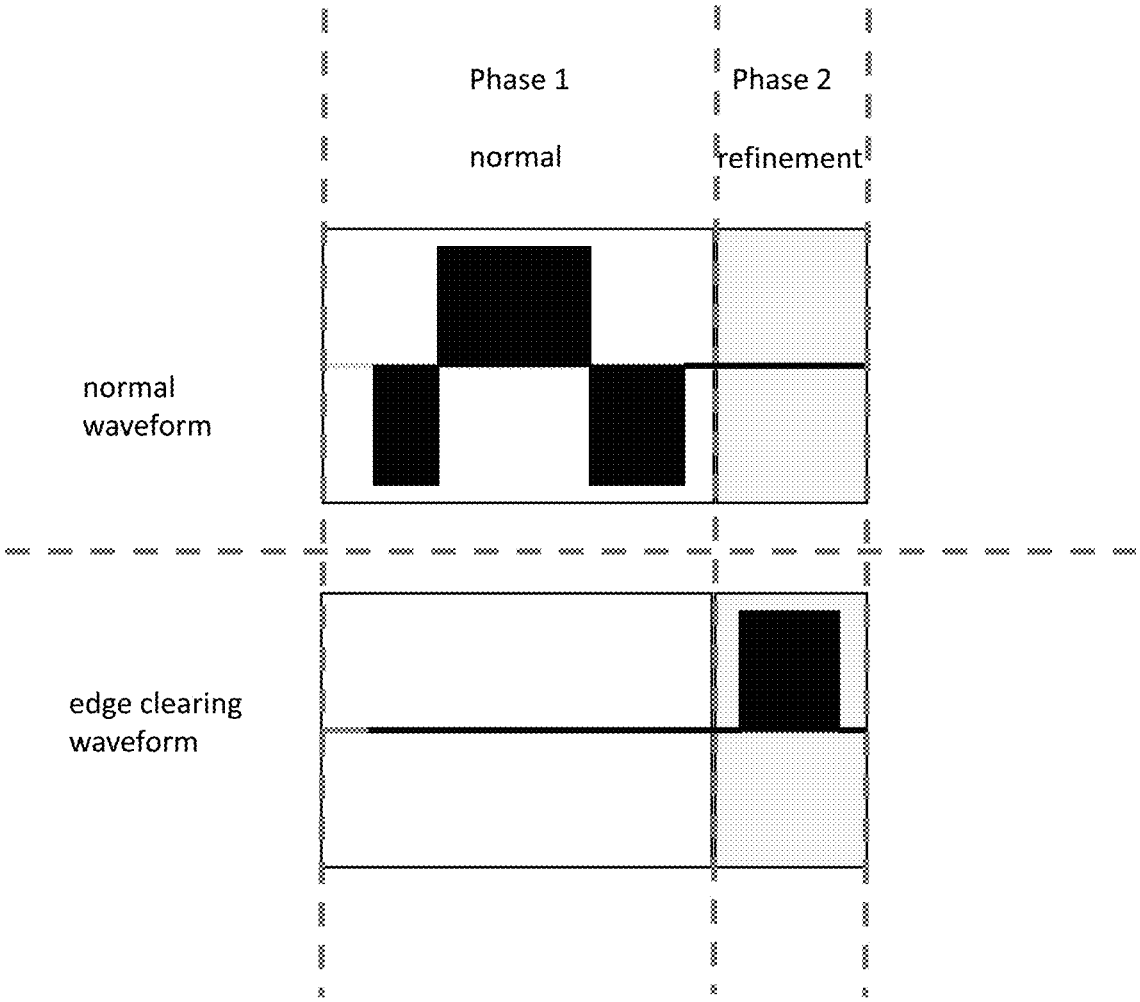
FIG. 5 are waveforms for implementing the dark mode swipe operation.
Figure 6:
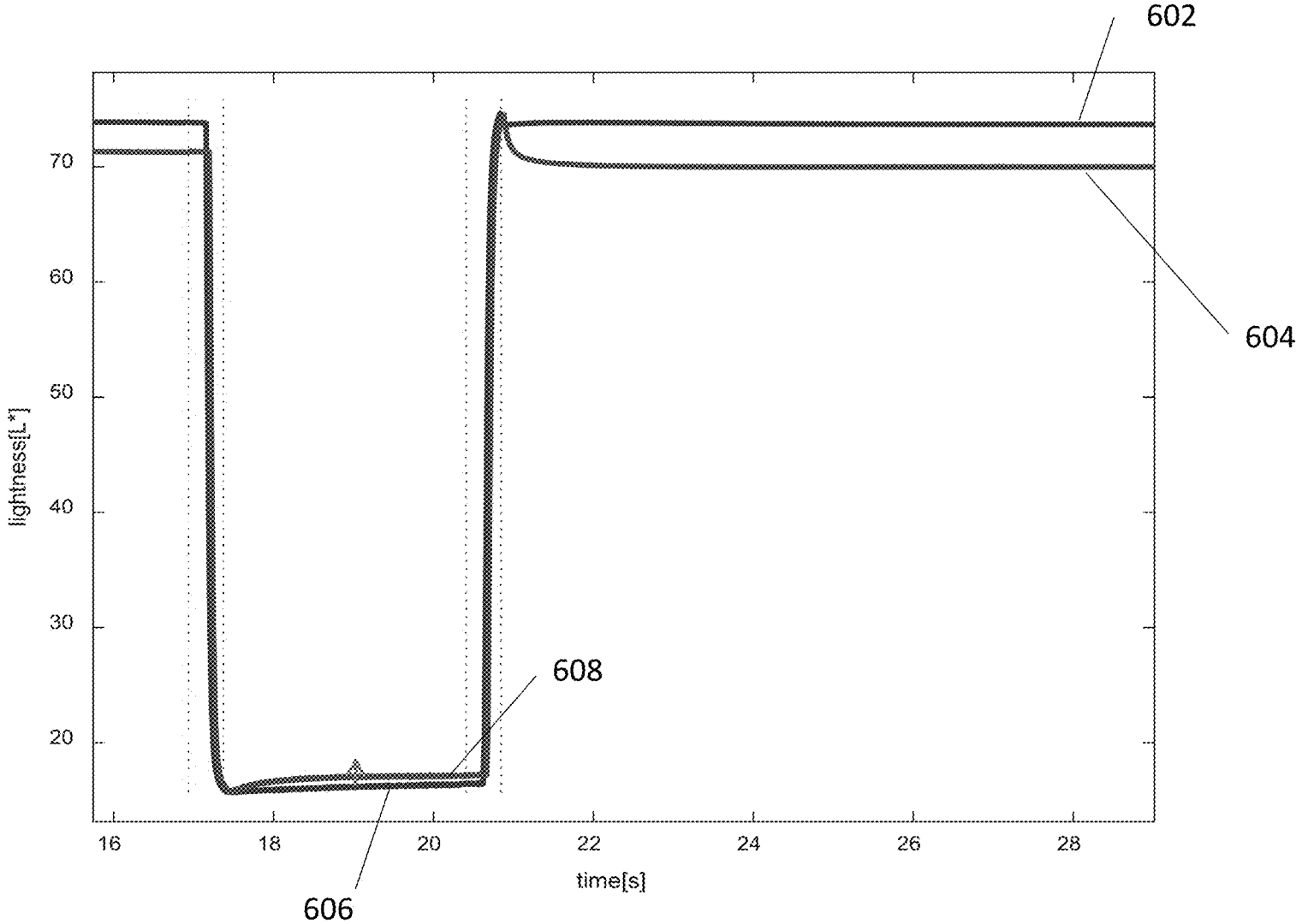
FIG. 6 illustrates optical kickback of white and black rail due to post drive discharging.

In some embodiments, in phase 2 404, the clearing of the edge artifacts can commence after the end of the phase 1 updating, where a time delay τ can be inserted in between the two phases. In practice, for seamless transition appearance and to avoid the user from detecting undesirable edge artifacts, τ should be as small as possible. To do this in practice one may either (1). Perform pipelining update of the edge map with a special edge erasing DC imbalance waveform with post drive discharging, or (2). Enable this by changing the waveform look-up-table to include the edge clearing waveform, and by justifying the rest of the standard transitions by addition of zero scan frames as shown in FIG. 5. As shown in FIG. 5, perform the updating scheme as described herein provides the option of not using a post drive discharge to discharge the built up remnant voltages, where post drive discharging can result in higher optical kickbacks. FIG. 6 illustrates a comparison of resulting optical kickback when post drive discharge is applied. The blue line 604 shows an increased optical kickback on white rail due to post drive discharging, compared to the red line 602 when no post drive discharging is applied. Similarly, the blue line 608 shows an increased optical kickback on black rail due to post drive discharging, compared to the red line 606 when no post drive discharging is applied.

Figure 7:
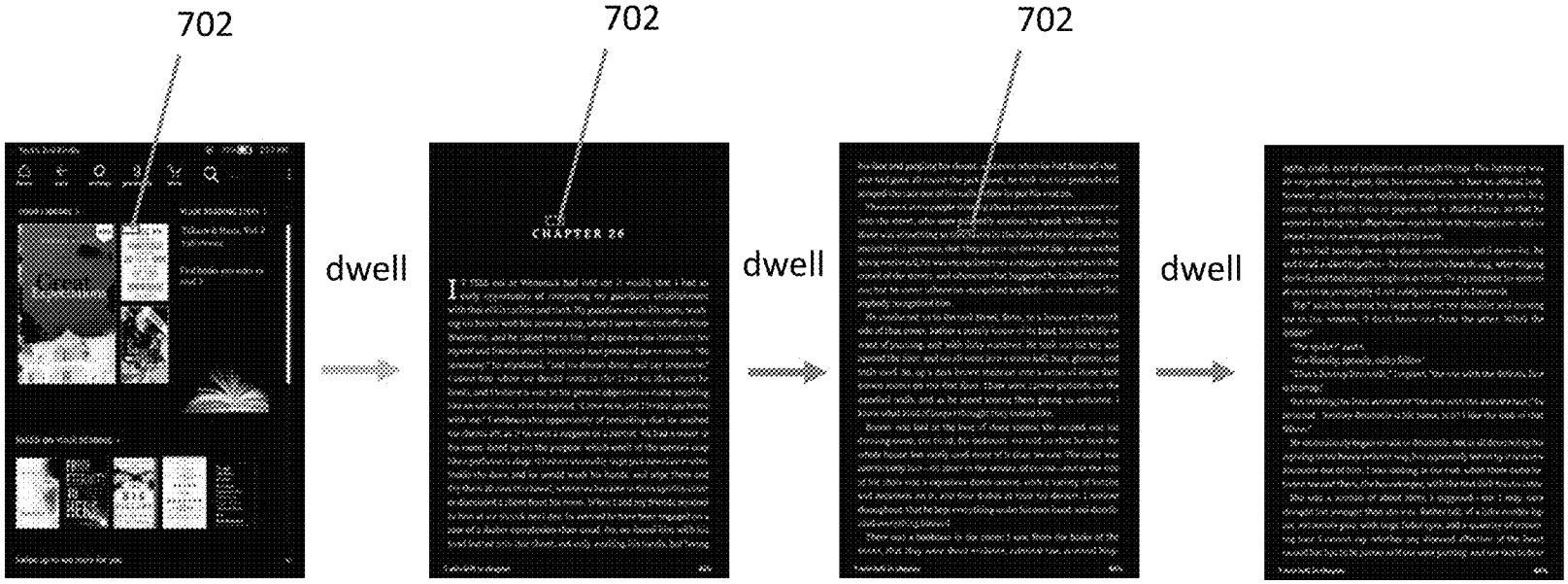
FIG. 7 illustrates the benefit of the two phase updating drive scheme in accordance with the subject matter disclosed herein.

In practice, applying the drive scheme as described herein allows one to perform multi-segmented swipe in dark mode without edge artifacts. Furthermore, optical kickback can be reduced in a typical usage scenario as shown in FIG. 7. Where "Kickback" or "Self-erasing" is a phenomenon observed in some electro-optic displays (see, for example, Ota, et al., "Developments in Electrophoretic Displays", Proceedings of the SID, 18, 243 (1977), where self-erasing was reported in an unencapsulated electrophoretic display) whereby, when the voltage applied across the display is switched off, the electro-optic medium may at least partially reverse its optical state, and in some cases a reverse voltage, which may be larger than the operating voltage, can be observed to occur across the electrodes.) Motivated by this usage scenario, the black background is always set by the use of a waveform which requires no edge clearing and hence negates the need for post drive discharging. The use for edge clearing comes only when the dark mode GL (i.e. empty black to black transition and/or white to white transition) is initiated in the next update sequence in which time a combination of the dwell and the update time of the GL transition has elapsed.

Figure 8:
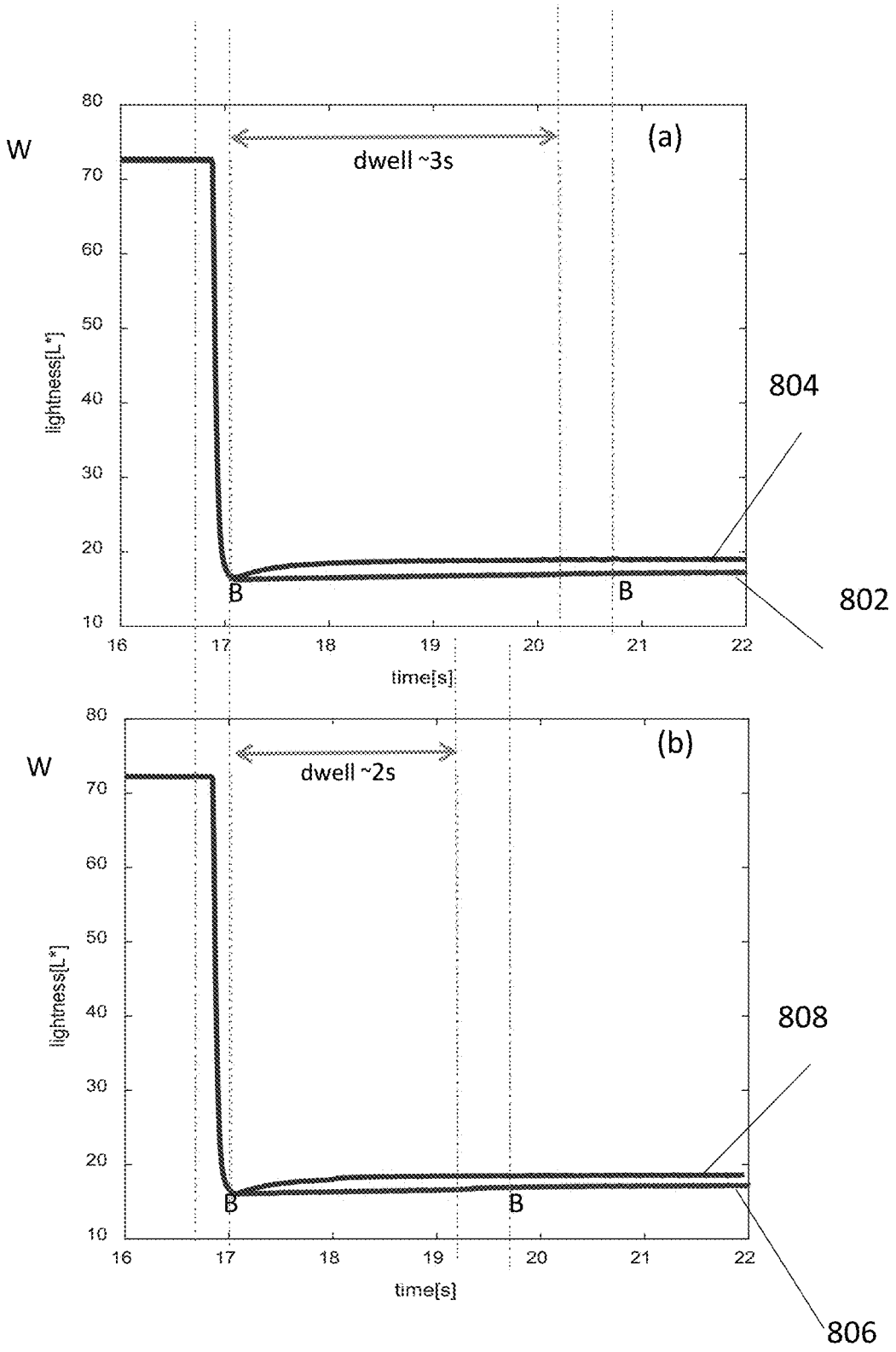
FIG. 8 illustrates black optical kickback with the two phase updating drive scheme.

In FIG. 7, the red box 702 motivates the important transition of setting the black background, where we have the following transition: White→Black→Black. FIG. 8 provides the optical trace comparing the case where we employ the proposed strategy (red line) 802, 806 and the alternative strategy for dark mode implementation (blue line) 804, 808. With the proposed strategy (red line) 802, 806, we have: White→Black using a waveform without post drive discharging to set the black background; Black→Black using the low-flash empty black to black waveform that ends with edge clearing with post drive discharging.

In addition, in some embodiments, one may perform a White→Black transition using a specialized waveform with post drive discharging to set the black background Black→Black using the low-flash empty black to black waveform and edge clearing with post drive discharging. As shown in FIG. 8, the proposed strategy (blue line) maintain a darker black than the current commercial strategy (red line). This is because the proposed strategy set black using a specialized waveform without the need for post drive discharging, and when post drive discharging is needed subsequently in phase 2 for edge clearing of the low-flash waveform, the black has already been set in place for a time duration of, T, where $$T = \text{dwell time} + \text{update time for the low flash waveform} + \tau$$

T allows for the natural decay of residual charges in the ink system, reducing the optical kickback due to the assertion of post drive discharging on the black background. As T reduces as shown in FIG. 8, the black of the proposed strategy will be less black with more optical kickback in the phase 2 of the proposed low flash waveform.

In one embodiment of the implementation, the minimum T can be pre-set to a value where the optical kickback is acceptable, then τ adjusted accordingly i.e.

$$\tau = \max(0, T\text{-dwell time-update time for the low flash waveform})$$

In another embodiment, update time for the low flash waveform+τ is always set to the acceptable optical kickback level. In yet another embodiment, the first low-flash update after which the black is set should always have a large T to ensure the majority of black background stay black and employ an over darken drive on area where the optical kickback is expected on subsequent low-flash update. The proposed approach can also be used in the day mode i.e. black text on white background. In its generalization, this strategy involves using: phase 1 as a drive mechanism to reach a desired coarse optical state (in this case, displaying text on black background but with issue with edge artifacts) and phase 2 as a drive mechanism to refine the optical state (in this case, clearing edges).

It will be apparent to those skilled in the art that numerous changes and modifications can be made to the specific embodiments of the invention described above without departing from the scope of the invention. Accordingly, the whole of the foregoing description is to be interpreted in an illustrative and not in a limitative sense.

The invention claimed is:

1. A method for driving an electro-optic displays having a plurality of display pixels, the method comprising:

updating the display with a first image using a drive scheme, the drive scheme configured to display white text on a black background;

identifying display pixels with edge artifacts using an algorithm, the algorithm configured to flag a display pixel for having edge artifacts when the display pixel's next graytone is black but at least one of the display pixel's cardinal neighbors has a current gray that is not black;

performing a time delay subsequent to the updating of the first image, wherein during the time delay edge artifacts are removed; and updating a second image to the display using the drive scheme.

2. The method of claim 1 further comprising a zero scan frame, wherein during the zero scan frame the plurality of display pixels are not being driven.

3. The method of claim 1 the removal of the edge artifacts comprising using a DC imbalanced waveform.

4. The method of claim 1 wherein the step of updating the display with a first image comprising using a drive scheme configured to apply no waveform to display pixels going through zero optical transitions.

5. The method of claim 3 further comprising performing a post drive discharging.

6. The display of claim 1, wherein the electric-optic display is an electrophoretic display having a layer of electrophoretic material.

7. The display of claim 6, wherein the electrophoretic material comprising a plurality of electrically charged particles disposed in a fluid and capable of moving through the fluid under the influence of an electric field.

8. The display of claim 7, wherein the electrically charged particles and the fluids are confined within a plurality of capsules or microcells.

9. The display of claim 6, wherein the electrophoretic material comprises a single type of electrophoretic particles in a dyed fluid confined with microcells.

10. The display of claim 6, wherein the electrically charged particles and the fluid are present as a plurality of discrete droplets surrounded by a continuous phase comprising a polymeric material.

11. The display of claim 10, wherein the fluid is gaseous.

* * * * *